US009980027B2

(12) United States Patent
Ikeda

(10) Patent No.: US 9,980,027 B2
(45) Date of Patent: May 22, 2018

(54) MICROPHONE AND HOUSING OF MICROPHONE

(71) Applicant: Tatsuya Ikeda, Tokyo (JP)

(72) Inventor: Tatsuya Ikeda, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days. days.

(21) Appl. No.: 15/239,933

(22) Filed: Aug. 18, 2016

(65) Prior Publication Data

US 2017/0070799 A1 Mar. 9, 2017

(30) Foreign Application Priority Data

Sep. 9, 2015 (JP) ..... 2015-177190

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 1/08*** | (2006.01) |
| ***H04R 1/04*** | (2006.01) |

(52) U.S. Cl.
CPC ..... *H04R 1/086* (2013.01); *H04R 1/04* (2013.01); *H04R 2410/07* (2013.01)

(58) Field of Classification Search
CPC ..... H04R 1/086; H04R 1/04; H04R 2410/07
USPC ..... 381/359
See application file for complete search history.

(56) References Cited

U.S. PATENT DOCUMENTS

| | | | | |
|---|---|---|---|---|
| 2,520,706 A * | 8/1950 | Anderson | ..... | H04R 1/086 181/242 |
| 2010/0054516 A1* | 3/2010 | Chan | ..... | H04R 1/086 381/359 |
| 2013/0064409 A1* | 3/2013 | Ikeda | ..... | H04R 1/08 381/356 |

FOREIGN PATENT DOCUMENTS

| | | |
|---|---|---|
| JP | 2000-78676 | 3/2000 |
| JP | 2004-235870 | 8/2004 |

* cited by examiner

*Primary Examiner* — Sean H Nguyen
(74) *Attorney, Agent, or Firm* — Whitham, Curtis & Cook, P.C.

(57) ABSTRACT

A microphone includes a microphone unit configured to convert a sound wave into an electrical signal. A cylindrical housing accommodates the microphone unit, and includes a a first opening portion that transmits the sound wave to the microphone unit. A sheet member having an air-permeable property and a water-repellent property covers the first opening portion. A frame including a second opening portion having a shape corresponding to a shape of the first opening portion covers the sheet member at a position of the first opening portion. A wind screen having a drainage property covers an exterior of the housing.

10 Claims, 6 Drawing Sheets

THE RELATED ART

* using : Vadjusted = ( ( Vraw ) ^ 2 – ( Vmeter internal noise ) ^2 ) ^ 1/2

THE RELATED ART

* using : Vadjusted = ( ( Vraw ) ^ 2 – ( Vmeter internal noise ) ^2 ) ^ 1/2

MICROPHONE AND HOUSING OF MICROPHONE

BACKGROUND

Technical Field

The present invention relates to a microphone and a housing for a microphone.

Related Art

Microphones used under conditions where they are exposed to water such as in the rain are covered with a rain cover to be protected from moisture, the rain covers being made of a material having a water-repellent property and a waterproof property such as polyvinyl chloride (PVC).

However, in the microphones covered with the rain cover, sound waves from an outside, mainly, low-band and high-band sound waves are attenuated by the rain cover. That is, the rain cover deteriorates frequency characteristics of the sound waves to be collected.

Further, to be protected from moisture, there is a microphone provided with a material having waterproof and moisture-permeable properties on an opening portion of a housing of the microphone. The material having waterproof and moisture-permeable properties has a high acoustic resistance value of material, and thus deteriorates the frequency characteristics of the sound waves to be collected. Further, many of the materials having waterproof and moisture-permeable properties are expensive.

Note that technologies regarding a microphone that is provided with a waterproof film on an opening portion of a housing to enhance a waterproof property are disclosed (for example, see JP 2000-78676 A and JP 2004-235870 A).

SUMMARY

In the conventional microphones, a decrease in acoustic performance such as deterioration of the frequency characteristics of the sound waves to be collected is caused in a case of enhancing the waterproof property, and waterproof performance is decreased in a case of considering the acoustic performance.

An objective of the present invention is to provide a microphone that achieves both waterproof performance and acoustic performance.

The present invention includes a microphone unit that converts a sound wave into an electrical signal, a cylindrical housing provided with a first opening portion that transmits a sound wave from an outside of the housing to the microphone unit, and accommodating the microphone unit, a sheet member having an air-permeable property and a water-repellent property, and covering the first opening portion, a frame including a second opening portion having a shape corresponding to a shape of the first opening portion, and covering the sheet member at a position of the first opening portion, and a wind screen having a drainage property, and covering an exterior of the housing.

According to the present invention, both waterproof performance and acoustic performance can be achieved.

DETAILED DESCRIPTION

Hereinafter, an embodiment of a microphone according to the present invention will be described with reference to the drawings.

<Configuration of Microphone>

Figure 1:
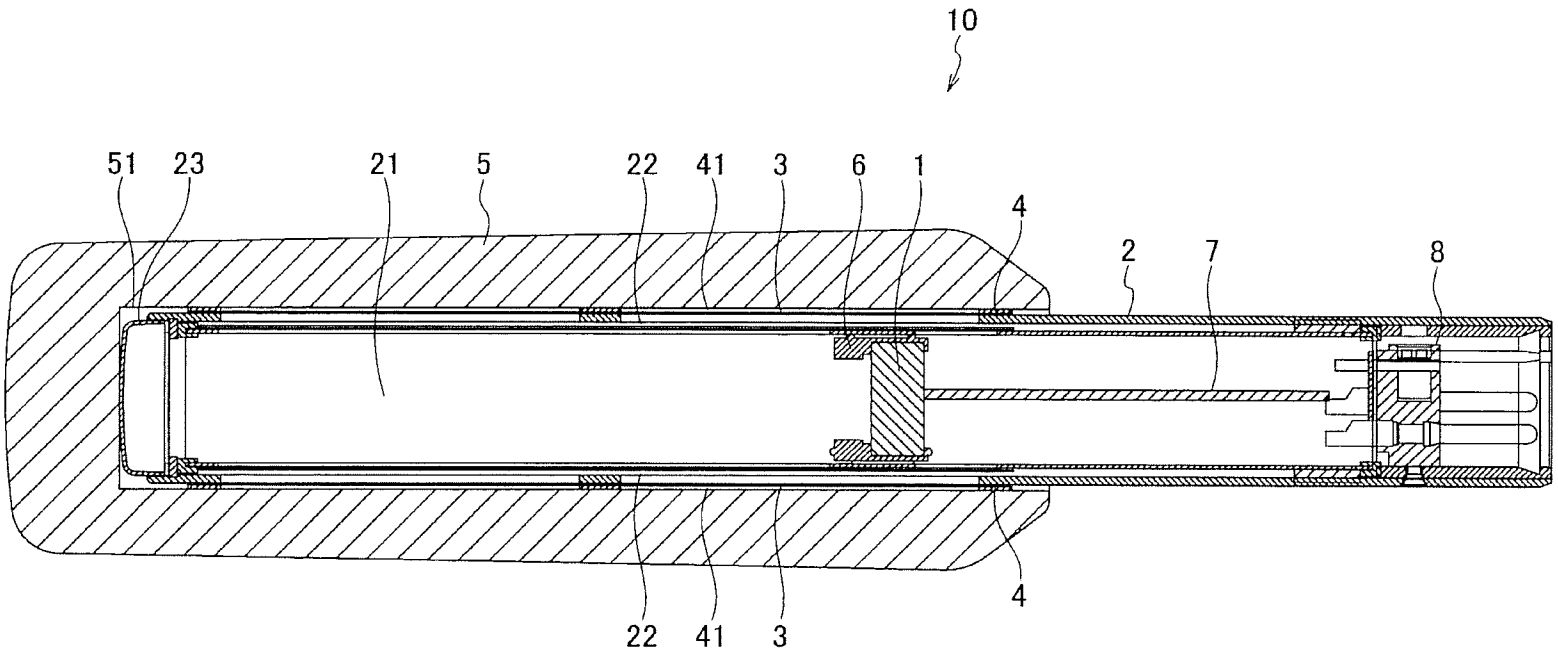
FIG. 1 is a sectional view of a side surface illustrating an embodiment of a microphone according to the present invention.

As illustrated in FIG. 1, a microphone 10 according to an embodiment of the present invention includes a microphone unit 1, a housing 2, a mesh material 3, a frame 4, a wind screen 5, and the like.

The microphone unit 1 includes a diaphragm. The microphone unit 1 converts a sound wave from outside of the microphone 10 into an electrical signal with the diaphragm. The microphone unit 1 is held in a predetermined position inside the housing 2 with a shock mount 6. The housing 2 includes a circuit board 7 at the rear of the microphone unit 1 (at the right side on the sheet surface of FIG. 1) inside the housing 2. A field effect transistor (FET) as an impedance transformer, an amplifier circuit, a low-cut circuit, and the like are mounted on the circuit board 7, for example. Further, the housing 2 includes an output connector 8 at the rear of the microphone unit 1 inside the housing. The output connector 8 is electrically connected with the circuit board 7.

The housing 2 is a tubular member which is hollow therein. The housing 2 configures an acoustic tube 21 at the front of the microphone unit 1 (at the left side on the sheet surface of FIG. 1) with the inside being hollow. The housing 2 includes a first opening portion 22 to transmit the sound wave from an outside to the diaphragm of the microphone unit 1. Further, the housing 2 includes a front cover 23 formed of a metal mesh, for example, on a front-side open end (hereinafter, referred to as "front end").

The mesh material 3 is provided to cover the first opening portion 22 from an exterior of the housing 2, for example. The mesh material 3 is formed of a sheet member made of a textile material having an air-permeable property that enables the sound wave from an outside to reach the microphone unit 1 inside the housing 2. The mesh material 3 is made of a textile material of a synthetic resin (for example, polyester), having a surface to which water repellent finish is applied, and has a water-repellent property. For the mesh material 3, a textile material having an air-permeable property of about 440 [cc/cm$^2$/second] by the Frazier method in JIS L1096 and a water-repellent property of grade 5 by the spray method in JIS L1092 is desirable.

Note that, for the textile material, a synthetic resin material having a water-repellent property, to which the water repellent finish is not applied, such as a polypropylene mesh or a polytetrafluoroethylene (Teflon®) mesh, may be used, other than the above-described polyester. Further, the mesh material 3 is not limited to the textile material formed in a mesh manner.

The frame 4 is provided at a position of the first opening portion 22. The frame 4 is provided to cover the mesh material 3. The frame 4 includes a second opening portion 41 having a shape corresponding to the shape of the first opening portion 22. The frame 4 forms a gap at an inside of the second opening portion 41.

The wind screen 5 is a cylindrical member corresponding to the shape of the housing 2. The wind screen 5 includes an accommodation portion 51 having a shape corresponding to the shape of the housing 2. For example, in a case where the housing 2 has an approximately cylindrical shape, the shape of the accommodation portion 51 is an approximately cylindrical recessed portion. The accommodation portion 51 is open at a rear end side of the wind screen 5 to accommodate the housing 2. The housing 2 of the microphone 10 is inserted into the accommodation portion 51 from the open rear end side, so that the housing 2 is covered with the wind screen 5.

The wind screen 5 suppresses noises caused by wind and the like outside the microphone 10 by covering the housing 2 of the microphone 10 with the accommodation portion 51 from an outside. The wind screen 5 is formed of a sponge such as urethane having a void ratio of 90% or more, for example.

<Configuration Around First Opening Portion of Housing>

Next, a configuration around the first opening portion 22 of the housing 2 of the microphone 10 will be described.

Figure 2:
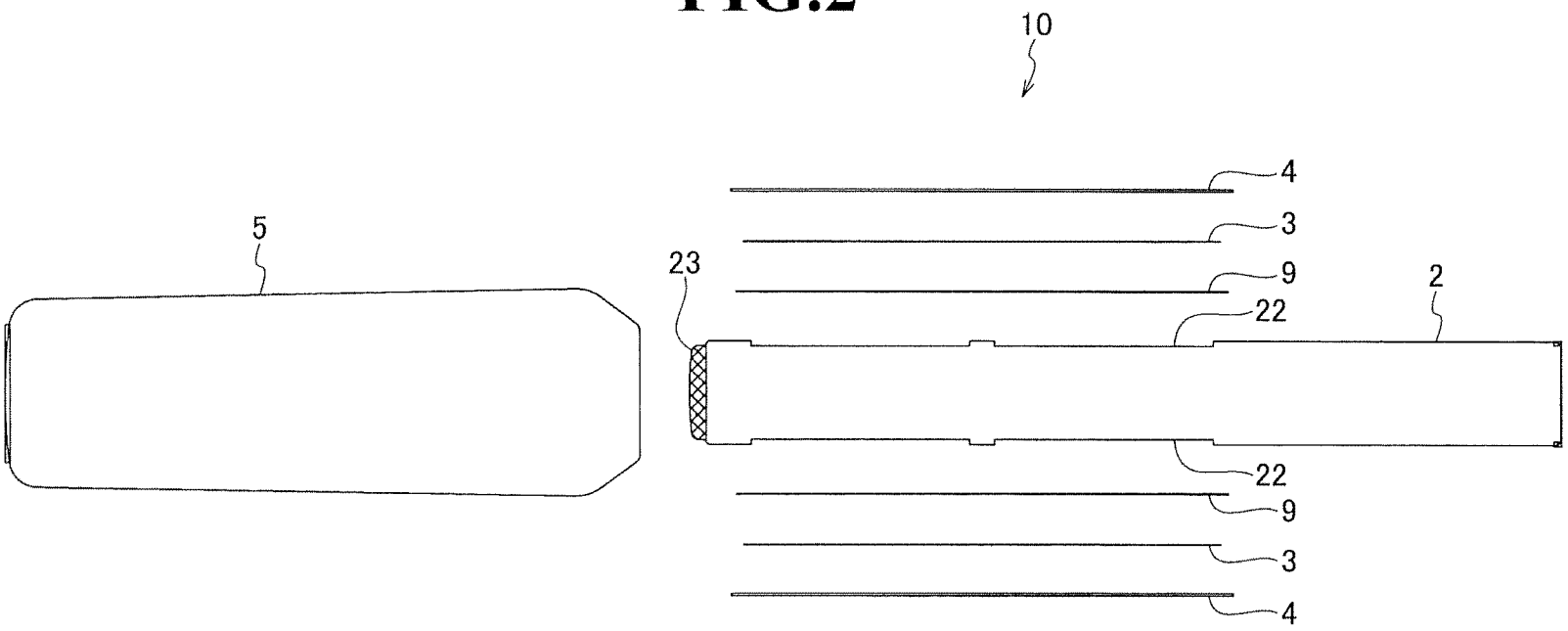
FIG. 2 is an exploded side view illustrating a state in which a housing, a mesh material, a double-stick tape, a frame, and a wind screen of the microphone of FIG. 1 are disassembled.

As illustrated in FIG. 2, a double-stick tape 9, the mesh material 3, and the frame 4 are provided on the housing 2 of the microphone 10 in order closest to the first opening portion 22.

The mesh material 3 is closely in contact with the exterior of the housing 2 and is attached to cover the first opening portion 22 with the double-stick tape 9. The frame 4 covers the first opening portion 22 together with the mesh material 3 and is attached to the exterior of the housing 2 with the double-stick tape 9. As illustrated in FIG. 1, the second opening portion 41 provided in the frame 4 faces the first opening portion 22. That is, the sound wave from an outside of the housing 2 of the microphone 10 is transmitted to the inside of the housing 2 through the first opening portion 22 and the second opening portion 41.

The size of the frame 4 is larger than the size of the mesh material 3 so that the frame 4 can cover the mesh material 3 when attached to the housing 2. The size of the double-stick tape 9 corresponds to the size of the frame 4 to stick the mesh material 3 and the frame 4 to the housing 2.

Note that the position of the double-stick tape is not limited to the example of the housing 2 of the microphone 10 according to the present embodiment. That is, the double-stick tape 9 may be provided between the frame 4 and the mesh material 3, and functions to stick the mesh material 3 and the frame 4 to the housing 2.

The wind screen 5 assumes a state as illustrated in FIG. 1 by being attached to the housing 2 to which the mesh material 3 and the frame 4 are stuck.

Figure 3:
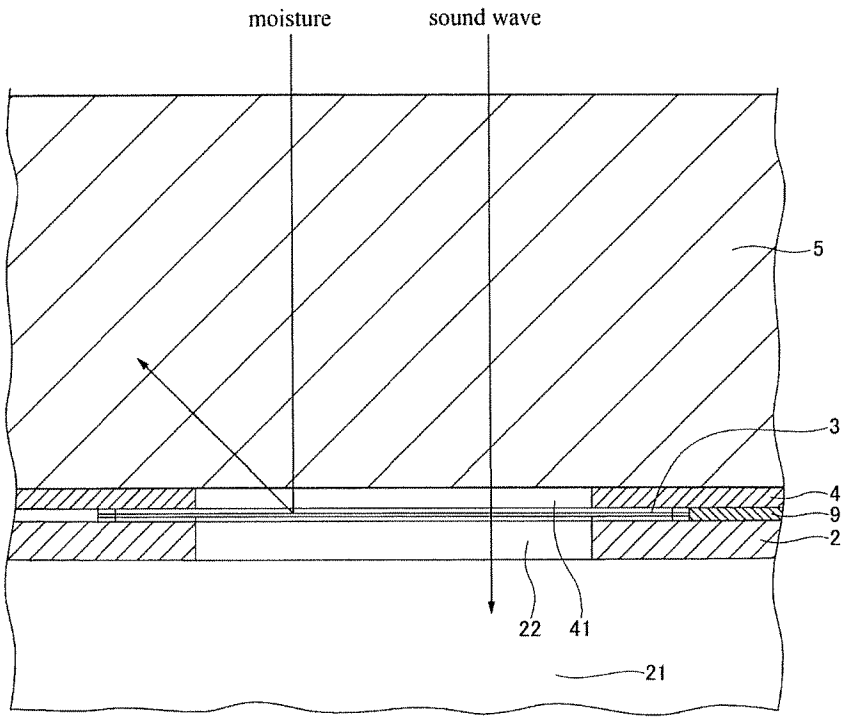
FIG. 3 is an enlarged sectional view of a side surface illustrating the microphone of FIG. 1.

As illustrated in FIG. 3, the frame 4, the mesh material 3, and the double-stick tape 9 are positioned on the microphone 10 in order from the exterior of the first opening portion 22 of the housing 2.

In the microphone 10, the wind screen 5 that covers the exterior of the housing 2 is formed of a urethane-made sponge (rough sponge) having a high void ratio of 90% or more, as described above. The urethane-made sponge having a high void ratio does not hold moisture, unlike a sponge used for a typical wind screen that has a low void ratio and is more likely to hold the moisture. When the microphone 10 is used under conditions exposed to water such as in the rain, water having reached the mesh material 3 from the wind screen 5 flows on the surface of the mesh material 3 and is drained. That is, the wind screen 5 has a high drainage property. Further, the microphone 10 includes the wind screen 5, so that water pressure applied to the mesh material 3 existing in a lower layer is decreased while the water passes through the wind screen 5. As described above, the microphone 10 including the wind screen 5 formed of the urethane-made sponge having a high void ratio can obtain high waterproof performance.

The frame 4 between the mesh material 3 and the wind screen 5 provided on the exterior of the housing 2 has a predetermined thickness. The frame 4 is provided with the second opening portion 41. With the frame 4, a gap is formed in the second opening portion 41 between the mesh material 3 and the wind screen 5.

This gap prevents application of force to the mesh material 3 even when external force is applied to the wind screen 5. Further, with the gap, respective surfaces of the mesh material 3 and the wind screen 5 are not in contact with each other around the first opening portion 22 and the second opening portion 41. Therefore, moisture from an outside of the microphone 10 is less easily directly reached from the wind screen 5 to the mesh material 3. By including the frame 4 having the predetermined thickness and including the second opening portion 41, the microphone 10 has higher waterproof performance than a case of including only the mesh material 3 having a water-repellent property.

Further, the gap formed by the frame 4 serves as acoustic capacity of the microphone 10, and acoustically forms a high-pass filter together with the wind screen 5. That is, the microphone 10 has high effects of decreasing wind noise with the frame 4.

As described above, the mesh material 3 is formed of the sheet member made of a synthetic resin such as polyester having an air-permeable property and a water-repellent property. The mesh material 3 transmits the sound wave from an outside and allows the sound wave to reach the microphone unit 1 inside the housing 2, and repels the moisture from outside.

The microphone 10 does not transmit the moisture to the microphone unit 1 and does transmit only the sound wave with the wind screen 5, the frame 4, and the mesh material 3, even under conditions exposed to water. That is, the microphone 10 achieves both waterproof performance and acoustic performance.

Figure 4:
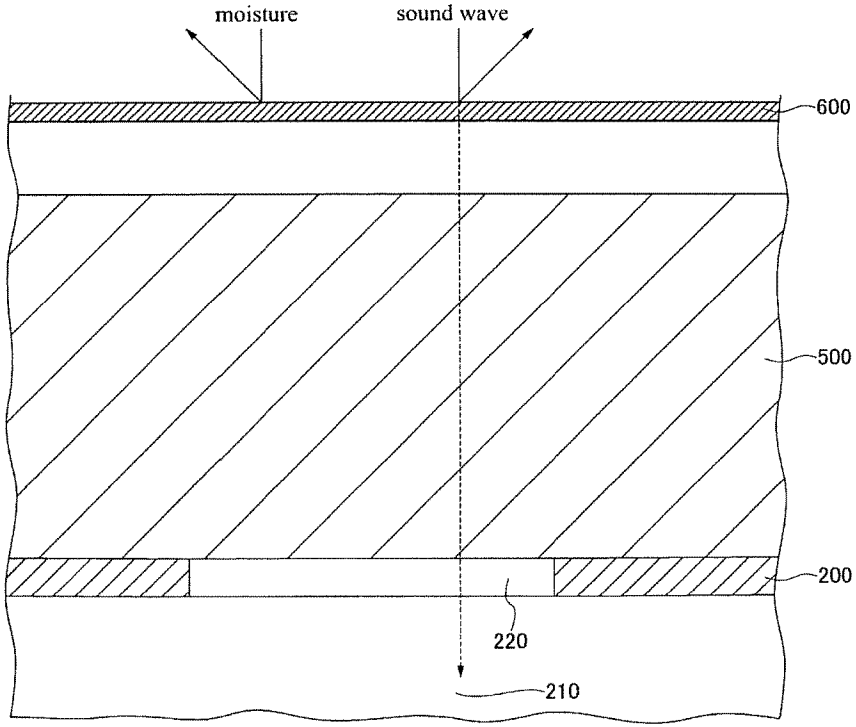
FIG. 4 is an enlarged sectional view of a side surface illustrating a microphone of a related art.

FIG. 4 is an enlarged sectional view of a side surface illustrating a microphone of a related art. A housing 200 of the microphone of a related art is directly covered with a wind screen 500. Therefore, the microphone of a related art is provided with the wind screen 500 on an exterior of an opening portion 220 that communicates an acoustic tube 210 inside the housing 200 and an outside. The microphone of a related technology is provided with a PVC-made rain cover 600 on an exterior of the wind screen 500 for waterproofing. When the rain cover 600 is used like the microphone of a related art, sound waves from an outside, mainly low-band and high-band sound waves are attenuated by the rain cover 600, and thus frequency characteristics of the sound waves to be collected are deteriorated.

Figure 5:
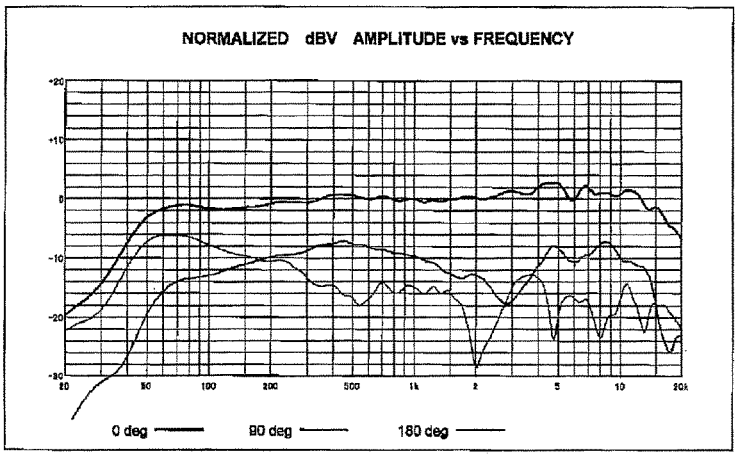
FIG. 5 is a graph illustrating directional frequency characteristics of the microphone of FIG. 1.
Figure 6:
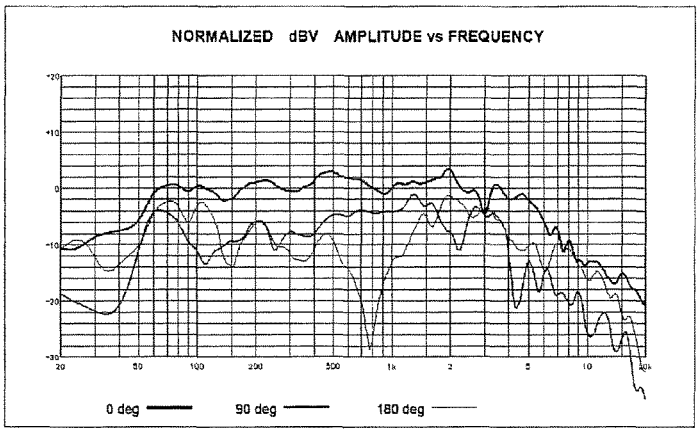
FIG. 6 is a graph illustrating directional frequency characteristics of the microphone of a related art.

Directional frequency characteristics of the microphone 10 and directional frequency characteristics of the microphone of a related technology covered with the PVC-made rain cover 600 of FIG. 4 are compared using the graph of FIG. 5 and the graph of FIG. 6. It is found that the microphone 10 can obtain excellent response characteristics in all of the frequency bands, unlike the microphone of a related technology covered with the PVC-made rain cover 600.

As described above, the microphone 10 according to the present embodiment can achieve both waterproof performance and acoustic performance.

What is claimed is:

1. A microphone comprising:

a microphone unit configured to convert a sound wave into an electrical signal;

a cylindrical housing provided with a first opening portion that transmits the sound wave to the microphone unit, wherein the cylindrical housing accommodates the microphone unit;

a sheet member having an air-permeable property and a water-repellent property, wherein the sheet member covers the first opening portion of the cylindrical housing, wherein the sheet member has a surface, wherein at least water repellency was imparted to the surface;

a frame including a second opening portion having a shape corresponding to a shape of the first opening portion, and covering the sheet member at a position of the first opening portion; and a wind screen having a drainage property by which water is permitted to pass through the wind screen and reach the sheet member, wherein the wind screen covers an exterior of the housing, wherein the frame has a predetermined thickness and is disposed between the sheet member and the wind screen, and wherein the frame forms a gap between the sheet member and the wind screen with the second opening portion.

2. The microphone according to claim 1, wherein the sheet member is in contact with the first opening portion and the housing, and wherein the sheet member is provided on the housing.

3. The microphone according to claim 1, wherein the sheet member is a mesh material formed of a synthetic resin material having a surface to which water repellent finish is applied.

4. The microphone according to claim 1, wherein the sheet member is formed of a polyester mesh material.

5. The microphone according to claim 1, wherein the wind screen is configured from a sponge having a void ratio of 90% or more.

6. A device for housing a microphone comprising:

a cylindrical housing accommodating a microphone unit that converts a sound wave from outside of the cylindrical housing into an electrical signal, wherein the cylindrical housing includes a first opening portion that transmits the sound wave to the microphone unit;

a sheet member having an air-permeable property and a water-repellent property, wherein the sheet member covers the first opening portion of the cylindrical housing, wherein the sheet member has a surface, wherein at least water repellency was imparted to the surface;

a frame including a second opening portion having a shape corresponding to a shape of the first opening portion, and covering the sheet member at a position of the first opening portion; and a wind screen having a drainage property by which water is permitted to pass through the wind screen and reach the sheet member, wherein the wind screen covers an exterior of the housing, wherein the frame has a predetermined thickness and is disposed between the sheet member and the wind screen, and wherein the frame forms a gap between the sheet member and the wind screen with the second opening portion.

7. The device according to claim 6, wherein the sheet member is in contact with the first opening portion and the housing, and wherein the sheet member is provided on the housing.

8. The device according to claim 6, wherein the sheet member is a mesh material formed of a synthetic resin material having the surface to which the water repellent finish is applied.

9. The device according to claim 6, wherein the sheet member is formed of a polyester mesh material.

10. The device according to claim 6, wherein the wind screen is configured from a sponge having a void ratio of 90% or more.

* * * * *